United States Patent [19]

Ishiguro

[11] Patent Number: 4,891,003

[45] Date of Patent: Jan. 2, 1990

[54] PULSE COMBUSTION DEVICE

[75] Inventor: Katsusuke Ishiguro, Nagoya, Japan

[73] Assignee: Paloma Kogyo Kabushiki Kaisha, Nagoya, Japan

[21] Appl. No.: 232,020

[22] Filed: Jul. 15, 1988

[30] Foreign Application Priority Data

Jul. 15, 1987 [JP] Japan ..... 62-176710

[51] Int. Cl.[4] ..... F23C 11/04

[52] U.S. Cl. ..... 431/1; 431/10; 431/12

[58] Field of Search ..... 431/1, 12, 10; 60/39.76, 39.77

[56] References Cited

U.S. PATENT DOCUMENTS

| | | | |
|---|---|---|---|
| 3,035,413 | 5/1962 | Linderoth | 60/39.74 X |
| 3,119,436 | 1/1964 | Rydberg | 431/1 |
| 4,260,361 | 4/1981 | Haber | 431/1 |
| 4,457,691 | 7/1984 | Hisaoka et al. | 431/1 |

FOREIGN PATENT DOCUMENTS

| | | | |
|---|---|---|---|
| 0108307 | 6/1983 | Japan | 431/1 |

*Primary Examiner*—Carl D. Price

*Attorney, Agent, or Firm*—Berman, Aisenberg & Platt

[57] ABSTRACT

A pulse combustion device wherein pulse combustion of a rich mixture of primary air and gaseous fuel is established without provision of conventional non-return valves. The pulse combustion device includes a housing forming therein a combustion chamber, a spark plug mounted on the housing and having an electrode located in the combustion chamber, an air intake nozzle plate formed with at least one air intake port and fixedly coupled within the housing to form an air intake chamber in open communication with the combustion chamber through the air intake port, at least one gas intake nozzle coupled with the air intake nozzle plate to admit a rich mixture of primary air and gaseous fuel under pressure therethrough into the combustion chamber, and a baffle plate secured in place within the housing at a position spaced from an inside surface of the air intake nozzle plate with a predetermined clearance in such a manner as to cover the air intake port and gas intake nozzle, the baffle plate being formed smaller in diameter than the housing to form an annular passage in open communication with the combustion chamber, and an electrically operated blower arranged to forcibly supply secondary air therefrom into the air intake chamber.

4 Claims, 2 Drawing Sheets

PULSE COMBUSTION DEVICE

BACKGROUND OF THE INVENTION

1. Field of the Invention

The present invention relates to a pulse combustion device, and more particularly to a pulse combustion device of the type which is supplied with a rich mixture of primary air and gaseous fuel and further supplied with secondary air to establish pulse combustion of the mixture therein.

2. Description of the Prior Art

As shown in FIG. 4, a conventional pulse combustion device of this kind comprises a housing 10 forming therein a combustion chamber 11, a spark plug SP mounted on the housing 10 and having an electrode located in the combustion chamber 11, an air intake valve plate 12 secured in place within the housing 10 to form an air intake chamber R, and a gas intake nozzle 13 coupled with the valve plate 12 to admit a rich mixture of primary air and gaseous fuel therethrough into the combustion chamber 11. The air intake chamber R is connected to an electrically operated blower B to be forcibly supplied with secondary air therefrom. The valve plate 12 is provided with air intake ports each controlled by a non-return valve $V_1$. The gas intake nozzle 13 is provided with a gas intake controlled by a non-return valve $V_2$. In such an arrangement of the pulse combustion device, a flame trap 14 is secured in place within the housing 10 at a position spaced from the valve plate 12 to prevent burning from taking place near the non-return valves $V_1$ and $V_2$. In activation of the pulse combustion device, moving parts such as the non-return valves $V_1$, $V_2$ occur unpleasant noises during pulse combustion of the mixture and are defaced inevitably, resulting in a trouble of the device in a short period of time. It is also difficult to partly control the pulse combustion in accordance with changes of a combustion load acting on the device.

SUMMARY OF THE INVENTION

It is, therefore, a primary object of the present invention to provide a pulse combustion device wherein pulse combustion of the mixture is established without provision of the conventional non-return valves to eliminate the occurrence of unpleasant noises during activation of the device.

According to the present invention, the primary object is attained by providing a pulse combustion device which comprises a housing forming therein a combustion chamber, a spark plug mounted on the housing and having an electrode located in the combustion chamber, an air intake nozzle plate formed with at least one air intake port and fixedly coupled within the housing to form an air intake chamber in open communication with the combustion chamber through the air intake port, at least one gas intake nozzle coupled with the air intake nozzle plate to admit a rich mixture of primary air and gaseous fuel under pressure therethrough into the combustion chamber, and a baffle plate secured in place within the housing at a position spaced from an inside surface of the air intake nozzle plate with a predetermined clearance in such a manner as to cover the air intake port and gas intake nozzle, the baffle plate being formed smaller in diameter than the housing to form an annular passage in open communication with the combustion chamber, and means for supplying secondary air under pressure into the air intake chamber.

BRIEF DESCRIPTION OF THE DRAWINGS

Other objects, features and advantages of the present invention will become more readily apparent from the following detailed description of a preferred embodiment thereof when taken together with the accompanying drawings, in which.

DESCRIPTION OF THE PREFERRED EMBODIMENT

Figure 1:
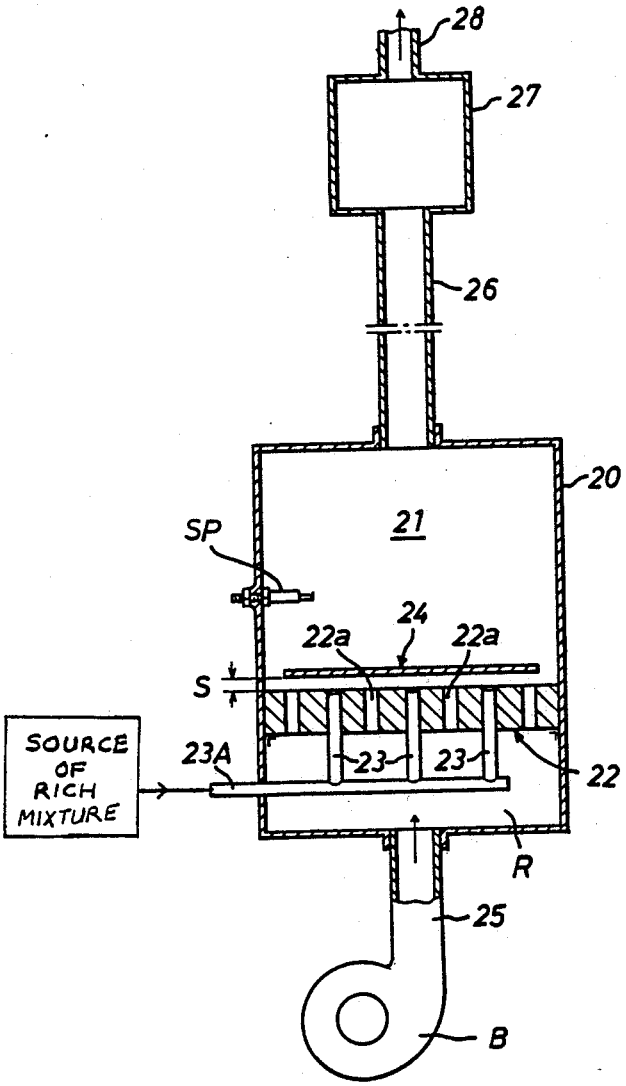
FIG. 1 is a sectional view of a pulse combustion device in accordance with the present invention.

Referring now to the drawings, a pulse combustion device of the present invention schematically illustrated in FIG. 1 comprises a cylindrical housing 20 forming therein a combustion chamber 21, a spark plug SP mounted on the housing 20 and having an electrode located in the combustion chamber 21, an air intake nozzle plate 22 formed with a plurality of parallel air intake ports **22*a* and fixedly coupled within the housing 20 in a fluid-tight manner to form an air intake chamber R in open communication with the combustion chamber 21 through the air intake ports 22*a*, a plurality of parallel gas intake nozzles 23 coupled with the air intake nozzle plate 22 to admit a rich mixture of primary air and gaseous fuel under pressure therethrough into the combustion chamber 21, and a circular baffle plate 24 secured in place within the housing 20 at a position spaced from the inside surface of air intake nozzle plate 22 with a predetermined clearance S in such a manner as to cover the air intake ports 22*a* and gas intake nozzles 23. The air intake chamber R is connected to an electrically operated blower B through an air duct 25 to be forcibly supplied with secondary air under pressure therefrom. The gas intake nozzles 23 are connected to a gas supply conduit 23A which is arranged to supply the rich mixture under pressure therethrough from a source of gaseous fuel (not shown) into the nozzles 23. The baffle plate 24 is formed smaller in diameter than the housing 10 to form an annular passage in open communication with the combustion chamber 21. The combustion chamber 21 is connected to a tailpipe 26 which is further connected to an exhaust pipe 28 through an expansion chamber 27**.

In an experimental use of the pulse combustion device, liquefied petroleum gas (purity 96.4%, Qfn L/min) was previously mixed with primary air (Qapn L/min) from a compressor (not shown) and supplied as a rich mixture of normality $\phi p = 3.0$ into the gas intake nozzles 23 through conduit 23A. In this instance, the supply pressure of the rich mixture was maintained at a high level to maintain the normality of the rich mixture at a constant in a wide range of fuel supply. For instance, the supply pressure of the rich mixture was maintained at a level of 0.5–35 KPa. On the other hand, the blower B was operated to forcibly supply the secondary air (Qasn L/min) into the air intake chamber R at a pressure of 0.1–3.0 KPa. In the experimental pulse combustion device, ten ports each of 4 mm in diameter were formed as the air intake ports **22*a*** in the nozzle plate 22, three nozzles each of 3 mm in diameter were adapted as the gas intake nozzles 23, a flate plate of 4 mm in thick was adapted as the baffle plate 24, and the clearance S between nozzle plate 22 and baffle plate 24 was determined as 3 mm. In addition, a pipe of 5.0 or 2.5 $cm^2$ in cross-sectional area (A) and of 2.0 or 1.0 m in length (L) was adapted as the tailpipe 26.

Performance characteristics of the experimental pulse combustion device were evaluated for combustion extent, fluctuation width of the pressure in the combustion chamber, combustion noise, carbon monoxide concentration and the like as described hereinafter.

(1) Combustion Extent and Turn-Down Ratio

The following table summarizes changes of the combustion extent in relation to the size of the tailpipe 26.

TABLE

| A/L (cm/m) | (Qfn)Max (L/min) | (Qfn)Min (L/min) | TDR | (ϕt)lean |
|---|---|---|---|---|
| 5.0/2.0 | 9.9 | | 9.9 | |
| 5.0/1.0 | 11.5 | | 11.5 | |
| 2.5/2.0 | 9.4 | 1.0 | 9.4 | 0.5 |
| 2.5/1.0 | 10.2 | | 10.2 | |

In the table, A/L represents the size of the tailpipe, TDR represents a turn-down ratio, and ϕt represents a lean limit of the mixture. As summarized in the table, a large turn-down ratio of 9.4–11.5 was obtained in the experimental pulse combustion device by the facts that the supply pressure of the rich mixture was maintained at a level of 0.5–35 KPa and that the secondary air was forcibly supplied at a pressure of 0.1–3.0 KPa. In the case that the tailpipe of 5.0 $cm^2$in cross-sectional area and of 1.0 m in length was used, the largest turn-down ratio of 11. 5 was obtained.

(2) Carbon Monoxide Concentration

Figure 2:
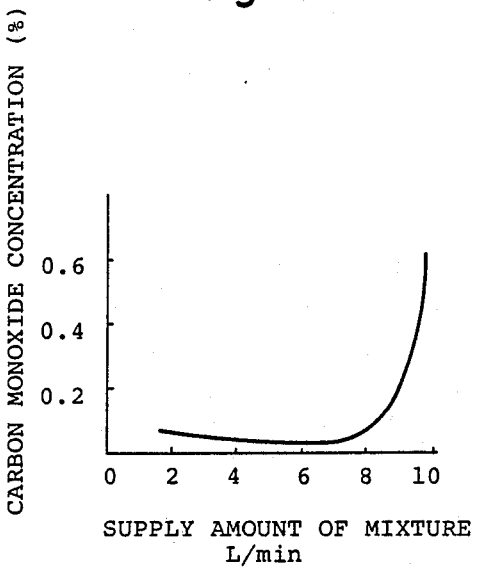
FIG. 2 is a graph showing carbon monoxide concentration in relation to a supply amount of the mixture.

In a graph of FIG. 2 there is illustrated a measurement result of carbon monoxide concentration in the experimental pulse combustion device wherein the tailpipe of 2.5 $cm^2$ and of 1.0 m in length was used. The graph of FIG. 2 shows the fact that the carbon monoxide concentration was maintained in a low value when the supply amount of the mixture was adjusted in a range of 2–8 L/min.

(3) Average Fluctuation Width of Pressure in the Experimental Pulse Combustion Device During activation of the experimental pulse combustion device, the baffle plate 24 was effective to increase the combustion extent of the mixture and to increase the pressure in the combustion chamber 21.

(4) Combustion Noise

Figure 4:
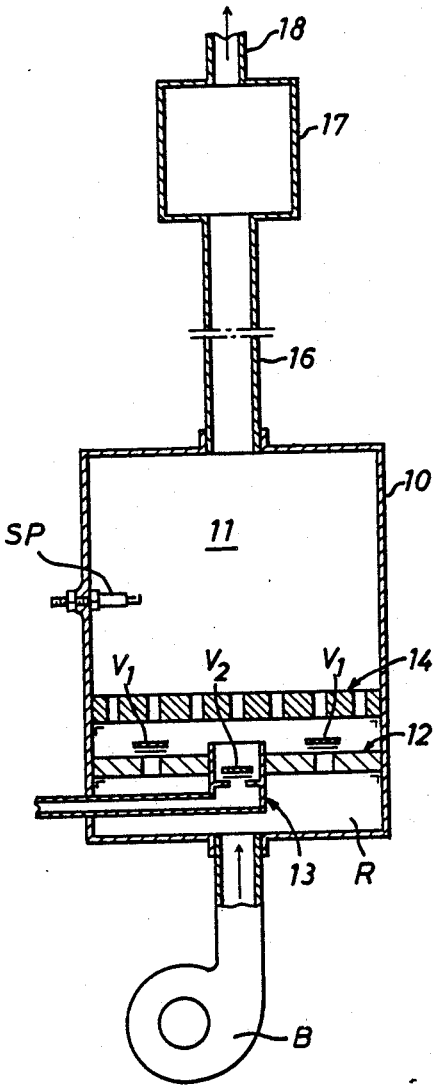
Fig. 4 PRIOR ART
FIG. 4 is a sectional view of a conventional pulse combustion device.
Figure 3:
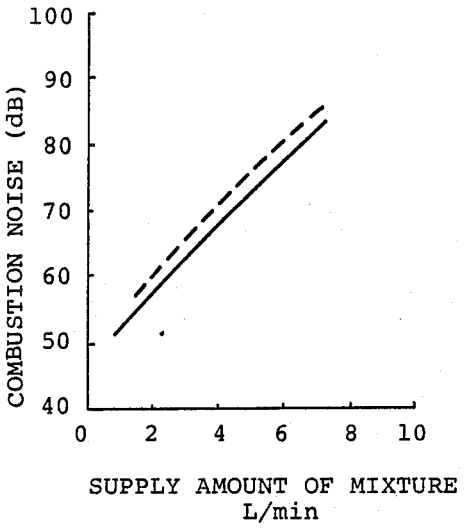
FIG. 3 is a graph showing noise levels in relation to a supply amount of the mixture.

In a graph of FIG. 3, a level of combustion noise measured in the experimental pulse combustion device is shown by a solid curve in comparison with a dotted curve showing a level of combustion noise in a conventional pulse combustion device of the type shown in FIG. 4. The graph of FIG.3 shows the facts that although in the conventional pulse combustion device a noise of 5–8 dB was caused by vibration of the non-return valves, such a noise was eliminated in the experimental pulse combustion device and that the combustion noise in the experimental pulse combustion device was reduced in accordance with decrease of the supply amount of the mixture.

Although the preferred embodiment of the present invention has been shown and described, it should be understood that various modifications and rearrangement of the parts may be resorted to without departing from the scope of the invention as disclosed and claimed herein.

What is claimed is:

1. A pulse combustion device comprising a housing forming therein a combustion chamber, a spark plug mounted on said housing and having an electrode located in the combustion chamber, an air intake nozzle plate formed with at least one air intake port and fixedly coupled within said housing in a fluid-tight manner to form an air intake chamber in open communication with the combustion chamber through the air intake port, at least one gas intake nozzle coupled with said air intake nozzle plate at one end thereof and connected to a source of a rich mixture of primary air and gaseous fuel at the other end thereof to admit the rich mixture of primary air and gaseous fuel under pressure therethrough into the combustion chamber, and means for supplying secondary air under pressure into said air intake chamber, wherein a baffle plate is secured in place within said housing at a position spaced from an inside surface of said air intake nozzle plate with a predetermined clearance from said air intake nozzle plate, wherein said baffle plate prevents the reverse flow of combustion products from the combustion chamber into the air intake port and gas intake nozzle, said baffle plate being formed smaller in diameter than said housing to form an annular passage in open communication with the combustion chamber.

2. A pulse combustion device as claimed in claim 1, wherein said air intake nozzle plate is formed with a plurality of parallel air intake ports for permitting the flow of secondary air passing therethrough from the air intake chamber into the combustion chamber, and wherein a plurality of parallel gas intake nozzles are coupled with said air intake nozzle plate to admit the rich mixture under pressure therethrough into the combustion chamber.

3. A pulse combustion device as claimed in claim 1, wherein said means for supplying secondary air under pressure comprises an electrically operated blower connected to the air intake chamber.

4. A pulse combustion device as claimed in claim 1, wherein said housing is of a cylindrical shape and said baffle plate is a circular plate smaller in diameter than said housing.

* * * * *